US007156057B2

(12) United States Patent
Lecrivain et al.

(10) Patent No.: US 7,156,057 B2
(45) Date of Patent: Jan. 2, 2007

(54) ELECTROMAGNETIC ACTUATOR FOR CONTROLLING A VALVE OF AN INTERNAL COMBUSTION ENGINE AND INTERNAL COMBUSTION ENGINE EQUIPPED WITH SUCH AN ACTUATOR

(75) Inventors: Michel Lecrivain, Ivry sur Seine (FR); Mohamed Gabsi, Cachan (FR); Hamid Ben Ahmed, Rennes (FR); Emmanuel Sedda, Conflans Sointe Honorine (FR); Christophe Fageon, Montrouge (FR)

(73) Assignees: CNRS Centre National de la Recherche Scientifique, Paris (FR); Peugeot Citroen Automobiles SA, Velizy Villacoublay Cedex (FR)

( * ) Notice: Subject to any disclaimer, the term of this patent is extended or adjusted under 35 U.S.C. 154(b) by 0 days.

(21) Appl. No.: 11/037,479

(22) Filed: Jan. 18, 2005

(65) Prior Publication Data

US 2005/0274335 A1 Dec. 15, 2005

(30) Foreign Application Priority Data

Jan. 15, 2004 (FR) ..... 04 50092

(51) Int. Cl.
*F01L 9/04* (2006.01)

(52) U.S. Cl. ..... 123/90.11; 251/129.01; 251/129.16

(58) Field of Classification Search ..... 123/90.11; 251/129.01, 129.15, 129.16
See application file for complete search history.

(56) References Cited

U.S. PATENT DOCUMENTS

| | | | | |
|---|---|---|---|---|
| 6,274,954 | B1 | 8/2001 | Gander et al. | |
| 6,334,413 | B1 * | 1/2002 | Hattori et al. | 123/90.11 |
| 6,763,789 | B1 * | 7/2004 | Liang et al. | 123/90.11 |

FOREIGN PATENT DOCUMENTS

| | | |
|---|---|---|
| EP | 0 405 191 A1 | 1/1991 |
| EP | 1 174 595 A1 | 1/2002 |
| JP | 08-004546 | 1/1996 |
| JP | 11-350929 | 12/1999 |
| JP | 2002-130510 | 5/2002 |

* cited by examiner

*Primary Examiner*—Ching Chang
(74) *Attorney, Agent, or Firm*—RatnerPrestia

(57) ABSTRACT

The present invention pertains to an electromechanical actuator controlling a valve of an internal combustion engine by means of a first magnetic field, generated in a variable manner by an electromagnet, and a second magnetic field, generated by at least one magnet associated with the electromagnet. According to the present invention, the actuator is characterized in that it comprises at least one connecting part forming a magnetic circuit facilitating the passage of the flux generated by the electromagnet for part of the field generated by the magnet, the connecting part being magnetically saturated by the partial field of the magnet.

12 Claims, 5 Drawing Sheets

FIG.1 PRIOR ART
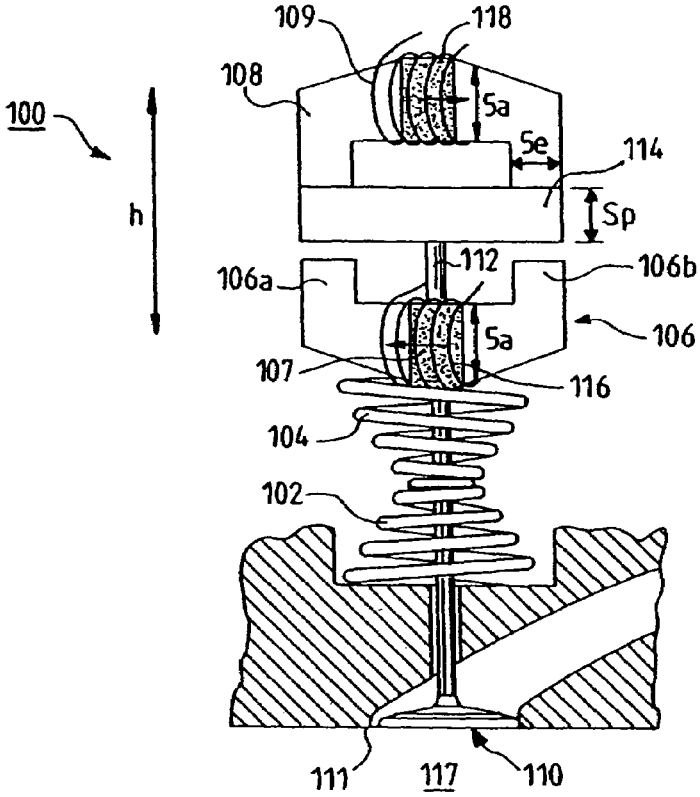
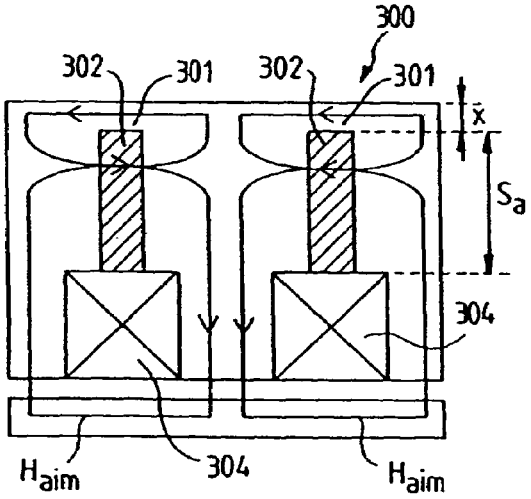
FIG.3a
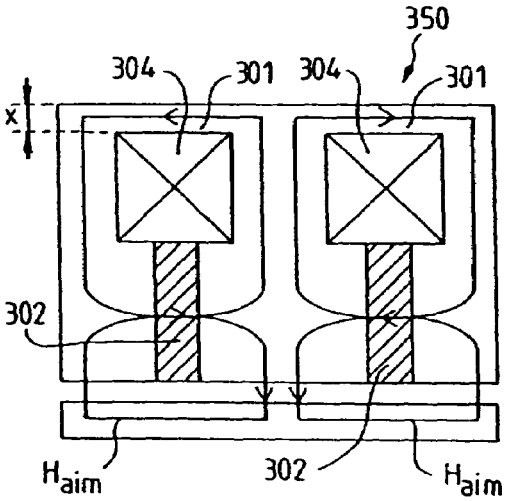
FIG.3b

ELECTROMAGNETIC ACTUATOR FOR CONTROLLING A VALVE OF AN INTERNAL COMBUSTION ENGINE AND INTERNAL COMBUSTION ENGINE EQUIPPED WITH SUCH AN ACTUATOR

This application claims priority under 35 U.S.C. §119(a) to French Patent Application No. 04 50092, filed on Jan. 15, 2004.

FIELD OF THE INVENTION

The present invention pertains to an electromagnetic actuator for controlling a valve for an internal combustion engine and to an internal combustion engine equipped with such an actuator.

BACKGROUND

An electromagnetic actuator 100 (FIG. 1) for a valve 110 comprises mechanical means, such as springs 102 and 104, and electromagnetic means, such as electromagnets 106 and 108, for controlling the position of the valve 110 by means of electric signals.

The stem of the valve 110 is applied for this purpose against the rod 112 of a magnetic plate 114 located between the two electromagnets 106 and 108.

When a current is flowing in the coil 109 of the electromagnet 108, the latter is activated and generates a magnetic field attracting the plate 114, which will come into contact with it.

The simultaneous displacement of the rod 112 permits the spring 102 to bring the valve 110 into the closed position, the head of the valve 110 coming against its seat 111 and preventing the exchanges of gas between the interior and the exterior of the cylinder 117.

Analogously (not shown), when a current is flowing in the coil 107 of the electromagnet 106, the electromagnet 108 being deactivated, it will be activated and attracts the plate 114, which will come into contact with it and displace the rod 112 by means of the spring 104 such that the rod 112 acts on the valve 110 and brings the latter into the open position, the head of the valve being moved away from its seat 111 to permit, for example, the admission or the injection of gas into the cylinder 117.

Thus, the valve 110 alternates between the open and closed positions, the so-called commuted positions, with transient displacements between these two positions. The state of an open or closed valve will hereinafter be called the "commuted state."

The actuator 100 may also be equipped with a magnet 118 located in the electromagnet 108 and with a magnet 116 located in the electromagnet 106, which said magnets are intended to reduce the energy needed to maintain the plate 114 in a commuted position.

Each magnet is located for this purpose between two subunits of the electromagnet with which it is associated in such a way that its magnetic field, possibly combined with the field generated by the electromagnet, reinforces the maintenance of the valve 110 in the open or closed position. For example, the magnet 116 is located between two subunits $\mathbf{106}_a$ and $\mathbf{106}_b$.

Due to the action of the magnet on the magnetic plate, such an electromagnet 106 or 108, called an electromagnet with a magnet or a polarized electromagnet, requires considerably less energy to control a valve, the maintenance of a valve in a commuted position representing a considerable energy consumption for the actuator.

SUMMARY OF THE INVENTION

The present invention results from the observation that in such a prior-art polarized actuator, the magnetic flux of the electromagnet passes through the magnet (or magnets) that is associated with it, which causes an increase in the equivalent air gap considered by the electromagnet during its action on the plate. As a consequence of this, a higher current and hence a higher consumption is necessary for the actuator to control the valve.

The present invention aims at accomplishing this object. It pertains to an electromagnetic actuator controlling a valve of an internal combustion engine by means of a first magnetic field, generated in a variable manner by an electromagnet, and a second magnetic field, generated by at least one magnet associated with the electromagnet, characterized in that the actuator comprises at least one connecting part forming a magnetic circuit facilitating the passage of the flux generated by the coil for part of the field generated by the magnet, the connecting part being magnetically saturated by this partial field of the magnet.

In such an actuator, the magnetic field of the electromagnet circulates via the connecting part of the actuator when the plate is attracted or maintained by the actuator such that the efficiency of the action of the electromagnet on the plate is not diminished by the presence of a magnet.

Consequently, the magnetic field of the electromagnet passes only partially through the magnet that is associated with it during this operation of the actuator (attraction and maintenance of the plate) such that there is no risk of the magnet being demagnetized.

Also, if a defluxing field intended to compensate the field of the magnet is used by the actuator during the separation from the plate, this field passes through the air gap in the direction opposite that generated by the magnet and thus reduces the force of attraction of the plate.

In addition, an actuator according to the present invention has a fixed magnetic circuit at the level of the electromagnet, which is formed by a single piece, which leads to good mechanical rigidity and increased ease of assembly of the actuator.

In one embodiment, with the electromagnet having the shape of an E, at least one magnet is located in one of the branches of this electromagnet, for example, one of the two end branches.

In one embodiment, at least one magnet is located in each of the branches of the actuator.

In one embodiment, the axis merged with the cross section of the magnet is inclined in relation to the axis of the E-shaped electromagnet.

According to one embodiment, the end branches have a cross section that is twice that of the central branch.

In one embodiment, when the electromagnet generates a magnetic field intended to move away a mobile magnetic plate in relation to the actuator, this field partially demagnetizes the associated magnet.

According to one embodiment, when the electromagnet generates a magnetic field intended to attract and/or maintain a mobile magnetic plate in relation to the actuator, the connecting part forms a magnetic circuit for this field of the electromagnet.

In one embodiment, the actuator comprises a plurality of magnets arranged symmetrically in the actuator, for example, above the coil of the electromagnet.

According to one embodiment, the actuator comprises a plurality of connecting parts.

In one embodiment, the actuator comprises at least one connecting part between the coil of the electromagnet and each magnet.

The present invention also pertains to an engine equipped with an electromagnetic actuator controlling a valve of an internal combustion engine by means of a first magnetic field, generated in a variable manner by an electromagnet, and a second magnetic field, generated by a magnet associated with the electromagnet, characterized in that the actuator, comprising an connecting part such that it forms a magnetic circuit for a part of the field generated by the magnet, the connecting part being magnetically saturated by this partial field of the magnet, corresponds to one of the embodiments described above.

Finally, the present invention pertains to a vehicle equipped with an electromechanical actuator controlling a valve of an internal combustion engine by means of a first magnetic field, generated in a variable manner by an electromagnet, and a second magnetic field, generated by a magnet associated with the electromagnet, characterized in that the actuator, comprising an connecting part such that it forms a magnetic circuit for part of the field generated by the magnet, the connecting part being magnetically saturated by the partial field of the magnet, corresponds to one of the embodiments described above.

BRIEF DESCRIPTION OF THE DRAWINGS

Other characteristics and advantages of the present invention will appear from the description given below as an illustrative and nonlimiting description of preferred embodiments of the present invention based on the attached figures, in which:

FIG. 1, already described, shows a prior-art polarized actuator,

FIGS. 2*a*, 2*b*, 3*a*, 3*b* and 4 show actuators according to the present invention, which are provided with an connecting part for each magnet comprised in these actuators.

DETAILED DESCRIPTION

Figure 2B:
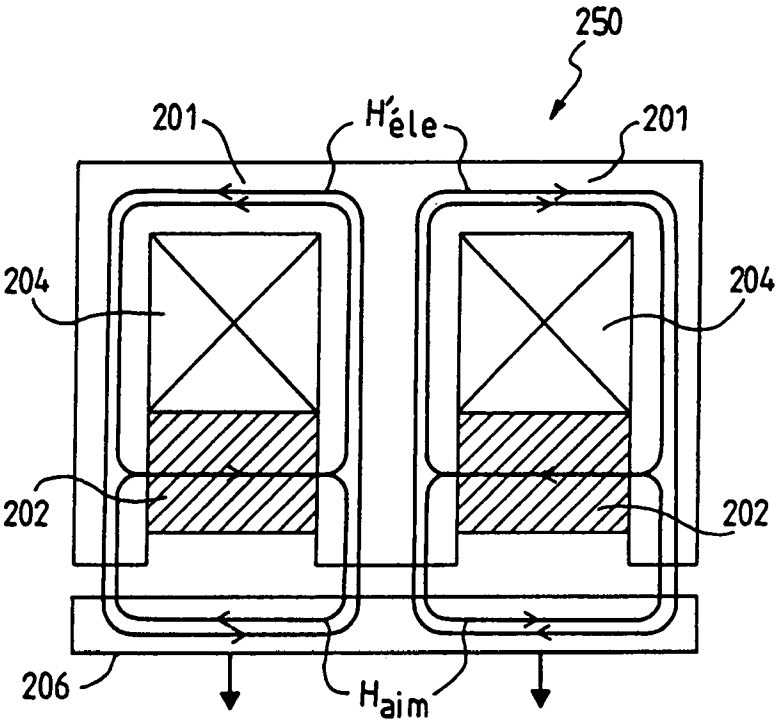
Figure 2A:
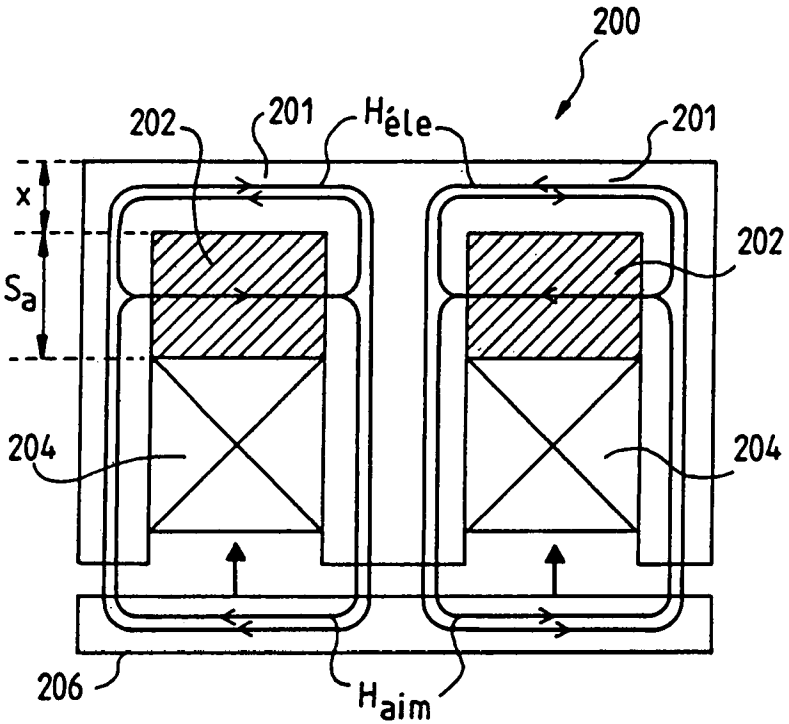

FIG. 2*a* shows an E-shaped actuator 200 equipped with magnets 202 generating a magnetic field $H_{mag}$, and an electromagnet 204 generating a magnetic field $H_{ele}$ for attracting and possibly maintaining the plate 206 against the actuator 200.

According to the present invention, the actuator comprises an connecting part 201 forming a magnetic circuit for a part of the field $H_{mag}$ generated by a magnet 202, this connecting part being magnetically saturated by this partial field of the magnet when the actuator is not generating any flux.

However, when the plate 206 is attracted by the actuator 200, the field $H_{ele}$ generated by the electromagnet 200 has a direction opposite the sense of the field of the magnet in this connecting part.

In other words, the action of the fields of the magnets 202 and of the electromagnet 204 is combined at the level of the plate 206, ensuring an intense action on the latter, whereas these fields have opposite senses at the level of the connecting part 201 in which the flux of the magnet $H_{ele}$ of the electromagnet is flowing.

Therefore, as was indicated above, this flux of the field $H_{ele}$ passes through the magnet 202 only partially, so that there is no risk of this electromagnet becoming demagnetized.

When the plate 206 is released by an actuator 250 (FIG. 2*b*) according to the present invention, the electromagnet 204 generates a field $H_{ele}$ of a direction opposite the direction of the field $H_{ele}$ used to attract or maintain the plate 206.

In this case, the field $H_{ele}$ of the electromagnet 204 is opposite the field $H_{mag}$ of the magnets 202 at the level of the plate 206, the action of the electromagnet opposing the action of the magnet in relation to the plate 206.

At the level of the connecting part 201, the fields $H_{ele}$ of the electromagnet 204 and $H_{mag}$ of the magnets are of the same direction, such that, the connecting part 201 being saturated, the field $H_{ele}$ of the electromagnet 204 passes partially through the magnets 202.

As will be described in detail below, such a situation offers the advantage of diminishing the magnetic field generated by the magnet and thus facilitating the release of the plate.

It appears that at a given magnet cross section Sa, the height x of such an connecting part 201 results from a compromise between the obtaining of the magnetic flux of the magnet required in the plate, for example, to ensure the maintenance of the latter in the commuted position, which requires low values of the height x of the connecting part, and the improvement of the mechanical rigidity of the electromagnet, as well as the improvement of the action of the electromagnet on the plate, which said improvements are facilitated by high values of the height x of the connecting part.

Finally, it should be noted that the actuator 200 described in connection with FIG. 2*a* differs from the actuator 250 described in connection with FIG. 2*b* in that the coil of the electromagnet 204 is located below (FIG. 2*a*) or above (FIG. 2*b*) the magnets 202.

Experiments have shown that the configuration in which the magnets are arranged above the coil was preferable in terms of energy consumption to the configuration in which the magnets are arranged below the coil.

Analogously, FIGS. 3*a* and 3*b* show actuators 300 and 350 which differ from one another only in the arrangement of the coils of the electromagnet 304 being considered below and above the magnets 302 associated with that electromagnet.

These embodiments also differ from the embodiments described in connection with FIGS. 2*a* and 2*b* in that the magnets 302 used have reduced thicknesses $e_a$ compared to the coil of the electromagnet 304, contrary to the embodiments described in connection with FIGS. 2*a* and 2*b*, in which the magnets 202 and the coil had equal thickness.

These reduced thicknesses $e_a$ offer the advantage of permitting the use of low-cost magnets 302 and of permitting a higher rigidity for the ferromagnetic circuits. Measurements have shown that magnet thicknesses between 2 mm and 8 mm were satisfactory.

Independently from the thickness of the magnets, connecting parts 301 of a height on the order of magnitude of 2 mm led to satisfactory results.

Finally, it should be stressed that for reasons of clarity, the field generated by the electromagnet 304 is not present in FIGS. 3*a* and 3*b*.

Figure 4:
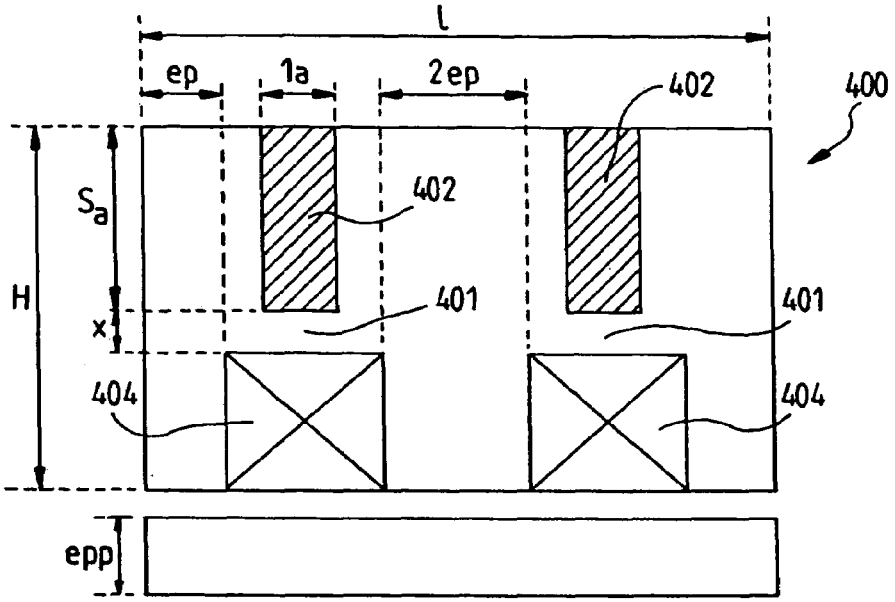

FIG. 4 shows another embodiment of the present invention in which an connecting part 401 is associated with each magnet 402 of the actuator 400, as was described above in FIGS. 2*a*, 2*b*, 3*a* and 3*b*.

However, the actuator 400 has the connecting parts 401 between the coil of the electromagnet 404 and the magnets 402 of the actuator.

Figure 5:
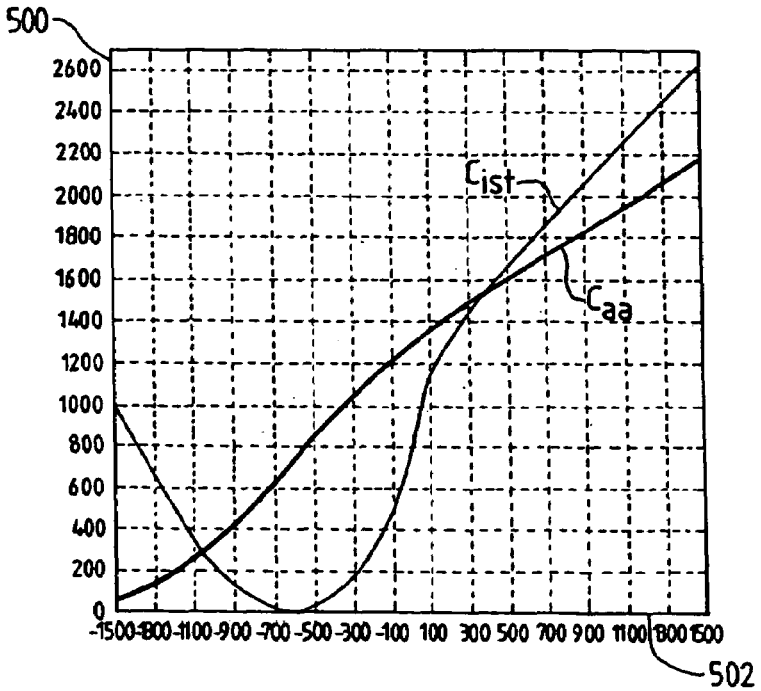
FIG. 5 shows the differences in efficiency between an actuator according to the present invention and an actuator according to the prior art.

FIG. 5 shows a diagram comparing the forces exerted by the polarized actuators either provided with an connecting part (curve $C_{ist}$) according to the present invention or not provided with an connecting part (curve $C_{pa}$) according to the prior art.

This diagram has an ordinate 500 indicating the force (in Newtons) exerted by an actuator being considered as a function of the current flowing in the coils of the electromagnets of these actuators, indicated on the abscissa 502 in A/turn.

It is thus seen that when a positive current flows in these coils and the actuator attracts the plate, the actuator according to the present invention (curve $C_{ist}$) exerts a stronger force on the actuator according to the prior art (curve $C_{pa}$).

In fact, the presence of an connecting part (connecting parts) in the actuator enables the latter to have a more effective electromagnet to reinforce the magnetic flux of the magnets given the absence of an equivalent air gap formed by the magnet in relation to the magnetic flux of the electromagnet, which flux flows in the connecting part.

When a negative current is flowing in the coil, i.e., when the plate is moving away from the actuator, the force exerted by the actuator comprising an connecting part decreases more rapidly than the force exerted by an actuator without an connecting part, which reduces the energy consumption necessary for the moving away of the plate.

Figure 6A:
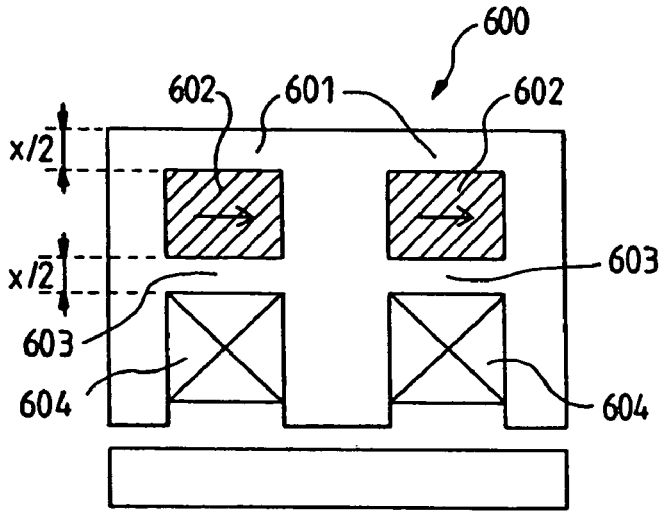
FIGS. 6*a*, 6*b* and 7 show actuators according to the present invention, provided with two connecting parts per magnet comprised in these actuators.
Figure 6B:
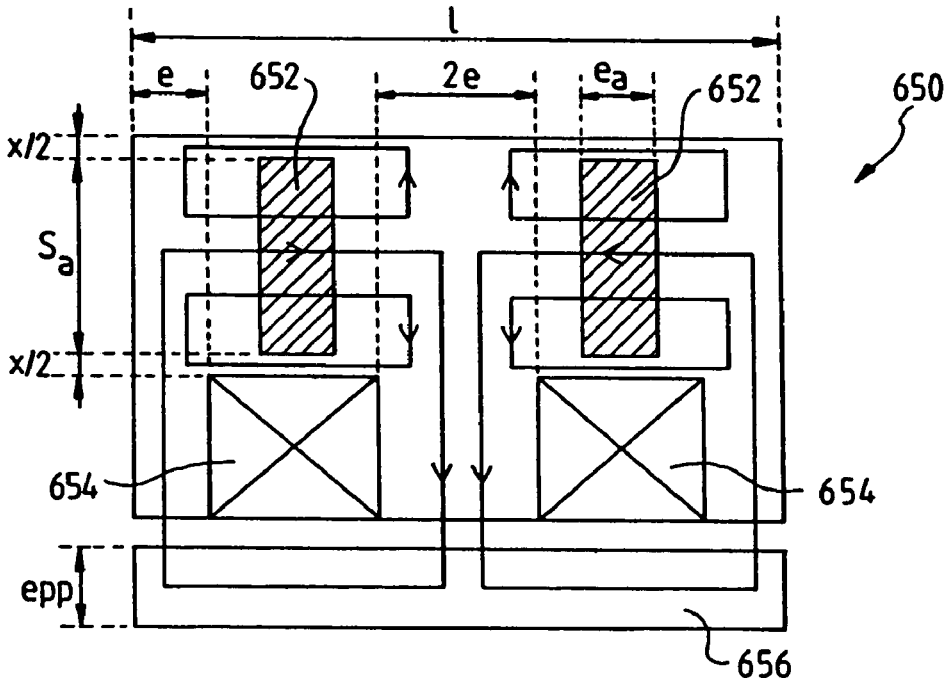

FIGS. 6*a* and 6*b* show other actuators 600 and 650 according to the present invention, in which two connecting parts 601 and 603 are located above the magnets 602 and between these magnets 602 and the coil of the electromagnet 604 being considered, respectively, this embodiment having the advantage of confining the magnets and facilitating the mechanical rigidity of the actuator.

In this embodiment, the connecting parts have a height x/2 that is half the height x of the connecting parts in the above embodiments, in which a single connecting part is associated with each magnet.

FIG. 6*b* shows an advantageous embodiment of an actuator 650 with two connecting parts per magnet, using magnets 652 of a small thickness $e_a$, and especially of a thickness $e_a$ smaller than the thickness of the coil of the electromagnet 654.

In addition, the ratios of the cross section Sa of the magnet and the thicknesses (e and 2e) of the branches of the ferromagnetic circuit are such that they concentrate the flux of the magnetic field at the level of the plate in order to increase its action.

According to other considerations optimizing the operation of the actuator, the thickness epp of the magnetic plate 656 is equivalent to the thickness e of the end branches of the actuator, whereas the height x/2 of the connecting parts is equal to half the height x of the connecting parts when a single connecting part is associated with one magnet.

Figure 7:
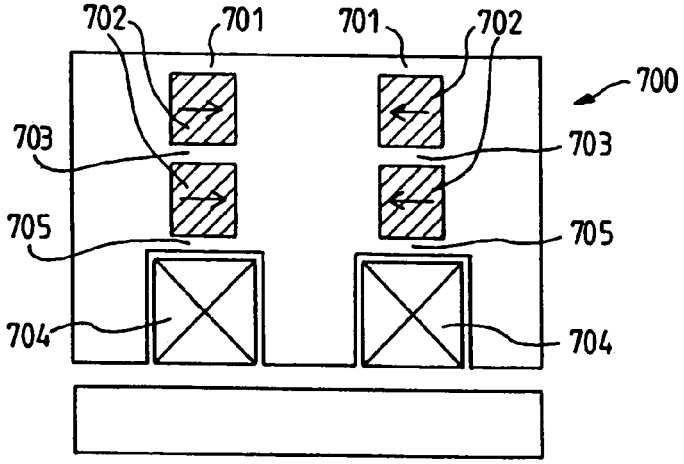

FIG. 7 shows an actuator 700 comprising four magnets 702 arranged in the actuator in such a way that they form three connecting parts 701, 703 and 705. Such a configuration has the advantage of having increased mechanical stability.

It should be noted at this point that the above-described embodiments use magnets whose edges are arranged in parallel to the edges of the coils of the actuator.

Now, it is possible to use magnets 802 (FIG. 8*a*, 8*b* or 8*c*) inclined in relation to the associated electromagnets in order to increase the cross section $S_a$ of the magnet at a fixed actuator height $H_a$, as will be described in detail below.

In a first embodiment (FIG. 8*a*), the actuator 800 comprises a magnetic circuit of a constant cross section by means of the magnetic plate 806, of a cross section epp practically equal to the cross section ep of the end branches of the E-shaped actuator and to half the cross section ep/2 of the central branch of this actuator, which leads to a concentration of the magnetic flux and consequently to an increase in the force exerted by the electromagnet 804 on the plate 806.

Thanks to such an arrangement, the cross section Sa of the magnets 802 can be larger than the height Ha available for accommodating the magnets in the electromagnet, this height Ha being equal to the height H of the electromagnet reduced by the height Hb of the coils of the electromagnet 804.

Permitting the cross section Sa of the magnet to be increased, this embodiment makes it possible to increase at the same time the action of the magnet on the plate and consequently to reduce the current consumption necessary for the electromagnet to act on the latter.

Figure 8A:
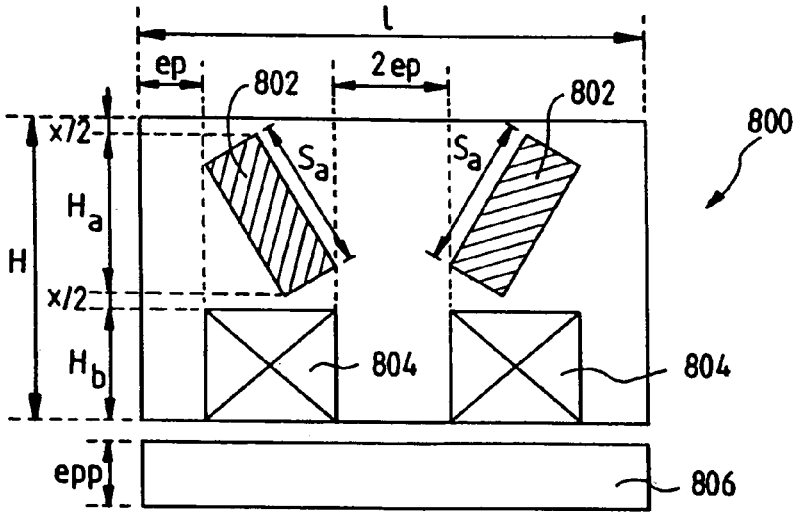
FIGS. 8*a*, 8*b* and 8*c* show actuators according to the present invention having a magnetic flux concentration of each magnet.
Figure 8B:
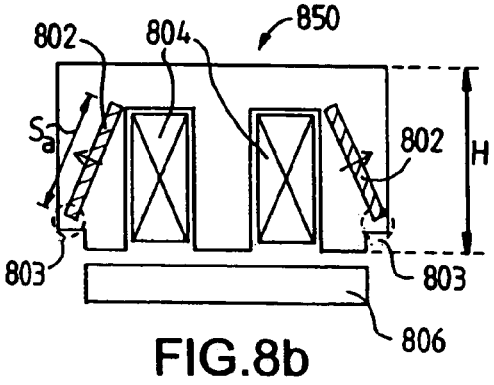
Figure 8C:
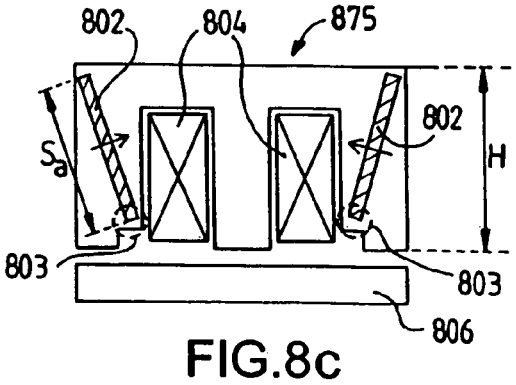

FIGS. 8*b* and 8*c* show other variants of actuators 850 and 875, whose magnets 802 are likewise inclined in relation to the respective electromagnets.

However, the magnets are located in the end branches of the electromagnets in these variants in such a way that these magnets 802 have a height H equal to the height of the electromagnet to be able to be accommodated in the latter.

In other words, the height of the coils of the electromagnet 804 is not limiting in relation to the cross section Sa of the magnets.

Conversely, the presence of magnets 802 does not represent any additional constraints in terms of the possible height of the coil of the electromagnets 804.

It should be noted that depending on the arrangement of the magnets in relation to the coils of the electromagnet 804, the electromagnet 850 or 875 has different properties.

Thus, such an arrangement (FIG. 8*b*) of the magnets 802 that the end 803 of the magnets 802 that is close to the plate 806 is also the end of this magnet 802, which end is moved away from the coil 804, has the advantage of using a plate of shorter dimensions than when (FIG. 8*c*) the end 803 of the magnets 802, which is close to the plate 806, is also the closest end of the coil 804.

However, it should be noted that when (FIG. 8*c*) the end 803 of the magnets 802 is also the closest end of the coil 804, the actuator has the advantage of permitting the use of magnets (802) of larger cross sections.

The embodiments described in connection with FIGS. 8*a*, 8*b* and 8*c* have the advantage of ensuring good maintenance of the magnets 802 because the latter are arranged inside the actuator.

The invention claimed is:

1. An electromechanical actuator controlling a valve of an internal combustion engine, said electromechanical actuator comprising:

an electromagnet configured to generate a first magnetic field in a variable manner, said electromagnet being configured to attract a mobile magnetic plate attached to the valve;

at least one magnet associated with the electromagnet, said at least one magnet being configured to generate a second magnetic field; and at least one connecting part which is magnetically saturated by a partial field of the magnet when the electromagnet is not generating any flux;

wherein the magnetic field of the electromagnet circulates through the connecting part when the mobile magnetic plate is attracted by the electromagnet.

2. An actuator in accordance with claim 1, characterized in that, the electromagnet has three branches in the shape of an E, the at least one magnet is located in one of the branches of the electromagnet.

3. An actuator in accordance with claim 2, characterized in that the at least one magnet includes three magnets located in the three branches of the actuator.

4. An actuator in accordance with claim 2 or 3, characterized in that an axis merged with a cross section of the at least one magnet is inclined in relation to an axis of symmetry of the E-shaped electromagnet.

5. An actuator in accordance with one of the claims 2 or 3, characterized in that the branches on the ends of the electromagnet have cross sections that are twice the cross section of the central branch.

6. An actuator in accordance with claim 1,-characterized in that when the electromagnet generates a magnetic field intended to move away a mobile magnetic plate in relation to the actuator, the field of the electromagnet partially demagnetizes the magnet.

7. An actuator in accordance with claim 1, characterized in that when the electromagnet generates a magnetic field tending to attract or maintain a mobile magnetic plate in relation to the actuator, the connecting part forms a magnetic circuit for the field of the electromagnet.

8. An actuator in accordance with claim 1, characterized in that it comprises a plurality of said magnets in the actuator above a coil of the electromagnet.

9. An actuator in accordance with claim 8, characterized in that it comprises a plurality of connecting parts.

10. An actuator in accordance with claim 8, characterized in that it comprises at least one said connecting part between the coil of the electromagnet and each magnet.

11. An engine equipped with an electromechanical actuator, said electromechanical actuator comprising:

an electromagnet configured to generate a first magnetic field in a variable manner, said electromagnet being configured to attract a mobile magnetic plate attached to the valve;

at least one magnet associated with the electromagnet, said at least one magnet being configured to generate a second magnetic field; and at least one connecting part which is magnetically saturated by a partial field of the magnet when the electromagnet is not generating any flux;

wherein the magnetic field of the electromagnet circulates through the connecting part when the mobile magnetic elate is attracted by the electromagnet.

12. A vehicle equipped with an electromechanical actuator, said electromechanical actuator comprising:

an electromagnet configured to generate a first magnetic field in a variable manner, said electromagnet being configured to attract a mobile magnetic plate attached to the valve;

at least one magnet associated with the electromagnet, said at least one magnet being configured to generate a second magnetic field; and at least one connecting part which is magnetically saturated by a partial field of the magnet when the electromagnet is not generating any flux;

wherein the magnetic field of the electromagnet circulates through the connecting part when the mobile magnetic plate is attracted by the electromagnet.

* * * * *